United States Patent [19]

Min-Chin et al.

[11] 4,369,644

[45] Jan. 25, 1983

[54] HIGH SPEED TWO TRAVELS THREAD ROLLING MACHINE

[76] Inventors: Chen Min-Chin; Chen Tung-Chen, both of No. 150, Li Te St., Taichung City, Taiwan

[21] Appl. No.: 169,639

[22] Filed: Jul. 17, 1980

Related U.S. Application Data

[63] Continuation of Ser. No. 965,415, Dec. 1, 1978, abandoned.

[51] Int. Cl.[3] ..... B21H 3/02

[52] U.S. Cl. ..... 72/92; 72/103; 72/424

[58] Field of Search ..... 72/92, 93, 94, 103, 72/424

[56] References Cited

U.S. PATENT DOCUMENTS

| | | | |
|---|---|---|---|
| 329,737 | 11/1885 | Harvey | 72/93 |
| 1,780,608 | 11/1930 | Swanson | 72/92 |
| 2,662,430 | 12/1953 | Fray | 72/92 |
| 2,727,255 | 12/1955 | Fray | 72/92 |
| 2,923,186 | 2/1960 | Pierson | 72/92 |
| 3,028,886 | 4/1962 | Drukker | 72/424 |
| 3,069,754 | 12/1962 | Wahun | 72/424 |
| 3,691,806 | 9/1972 | Hanzawa | 72/92 |

*Primary Examiner*—Lowell A. Larson

*Attorney, Agent, or Firm*—Blair, Brown & Kreten

[57] ABSTRACT

Disclosed herein is a new mechanism for making screws. It consists of two stationary segmented dies and an intermediate rotary die and by means of rotation, the rotary die threads working pieces which become screws. It includes a pneumatic feeding holder so that working pieces can be fed into the rotary die accurately and quickly and with the action of double die dual path, a high speed mass production is achieved.

8 Claims, 9 Drawing Figures

HIGH SPEED TWO TRAVELS THREAD ROLLING MACHINE

This is a continuation of application Ser. No. 965,415 filed Dec. 1, 1978, now abandoned.

BACKGROUND OF THE INVENTION

For years there have been improvements in the technology of screw making. Heretofore, threads were cut by lathe directly. Sequential screw cutting lathes were used and then different dies were applied. However, each die can be used for making simple screws conforming to one specification. Ways of using the dies are:

(1) Cylindrical Die Thread Rolling, which is subdivided into a two-die type and a three-die type. Its principle is the rolling of working pieces in two or three dies to make threads and form screws.

(2) Radial Rolling, by which a working piece is placed between two dies and their mutual movement threads the working piece and forms a screw.

In addition, penetration rolling and other methods have been used. In these methods, the die itself may involve the space for rolling and accuracy of threading. More complicated feeding equipment is thus required. Therefore, in the application of any of these above methods, the speed is low and mass production becomes impossible.

SUMMARY OF THE INVENTION

The principle for this invention herein disclosed is: Planetary Thread Rolling, which applies the interaction of a rotary die and a stationary segment die. A screw is formed by placing a working piece in a space between the rotary die and stationary segment die. The advantages of this method are: (1) high precision; (2) simple construction and (3) fast revolution in the rolling process.

The inventors' detailed research provides benefits over the principle and function of a planetary segment die. With traditional methods, the key for increasing production is in the control of the material feeding process and rolling process. Chain sheave feeding is the most popular way for such type machines, but its major disadvantage is the complication of chucks which must clamp on heads of headed screws and feed them to a die. However, it is not able to make headless screws since only head screws can be fed since clamping is impossible and the working pieces are not properly positioned and not able to be rolled to form screws.

Furthermore, in the operation of a stationary segment die and a rotary die, an extremely large standing force is required. If the standing force is insufficient, then the rotary die to stationary segment die orientation will be slightly distorted and the finished screws will not have enough precision. In such a process, chain driving and chuck holding are required. Therefore, more space is used, and improvement of production and speed is impossible.

For overcoming these disadvantages in screw making, the inventors have caused a breakthrough to the whole feeding process, not only from its simple structure but also by manufacturing quickly and precisely. Furthermore, balanced standing forces are applied. Two stationary segment dies and a rotary die are used for threading. Two feeding holders are used for dual path high speed rolling. Therefore, the production capacity is doubled.

It is an objective of this invention to provide pneumatic and fully automatic operation for labor savings.

Another object of this invention is to provide a feeding holder which can be adapted for head or headless screws of different specifications so that the machine is thus more versatile.

Another objective of this invention is to provide a three point holding system in conjunction with the feeding holder so that working pieces can be fed into the die precisely in order to avoid defective products due to declination of the working pieces.

DESCRIPTION OF THE PREFERRED EMBODIMENT

Figure 1:
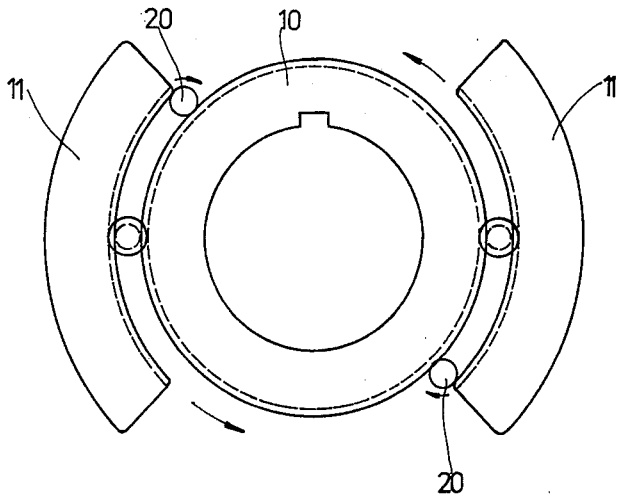
FIG. 1: This drawing illustrates the principle of planetary thread rolling as described in the application from a top plan view.
Figure 2:
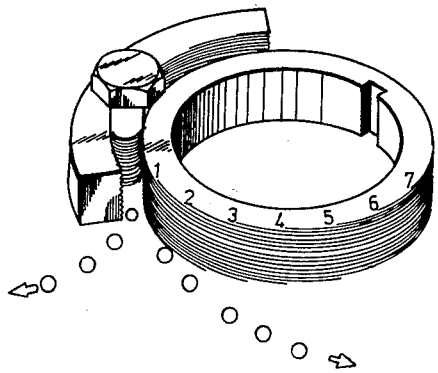
FIG. 2: Illustrated is a fixed point feeding in a planetary thread rolling machine in perspective.

FIG. 1 shows the basic principle of planetary thread rolling as applied in the invention: when working piece 20 is fed in a gap between rotary die 10 and stationary segment 11, then, for a definite path of travel, with accurate feeding and along a specified operational direction, screws can be accurately threaded. However, the major production problem with this method is the difficulty in feeding since clamping of the material always causes incorrect feeding. Therefore, a balance chuck is always required but then only a certain specification of head screws can be rolled. Since an accurate fixed point feeding is required in planetary thread rolling, feeding should be made in proper sequence at the beginning of each screw travel (i.e. points 1,2,3,4 . . of the starting points on the die as shown on FIG. 2). Otherwise, the thread will be damaged or defective and unuseable.

Figure 6:
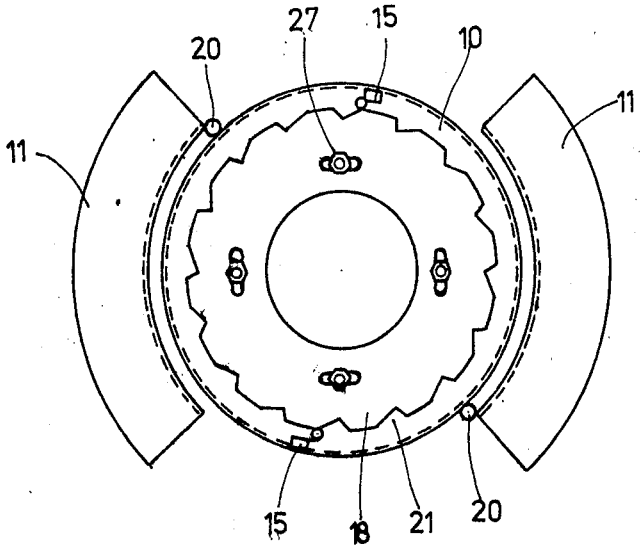
FIG. 6: A top plan view of FIG. 3.
Figure 3:
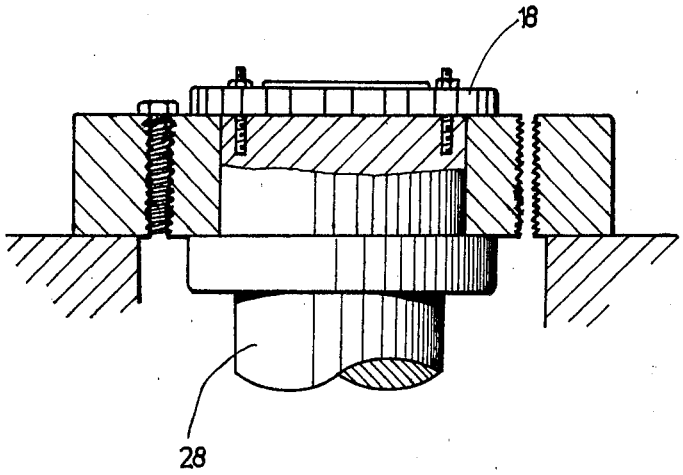
FIG. 3: A design of the high speed dual paths of the invention in section.

FIGS. 5 and 6 are the basic structure for a High Speed Dual Path Thread Rolling Machine as disclosed herein: The Rotary Die 10 and stationary segment dies 11 are the major dies. For accurate thread rolling, working pieces have to be accurately fed at the rolling starting point. Therefore, a cam 18 is attached to the spindle 28 (FIG. 3) of the rotary die 10. On the cam 18 there are grooves with a number equal to that of the rolling starting points on the rotary die 10. Every groove is cut precisely. By means of contact of the circumference of cam 18 and microswitch 15, the grooved circular surface will function uninterrupted and then control the feeding holders and other components. The cam 18 is fixed with four bolts 27 and it is precisely adjustable in conjunction with the rolling starting points on the rotary die so that closer and more precise contact with the microswitch is achieved.

Figure 7:
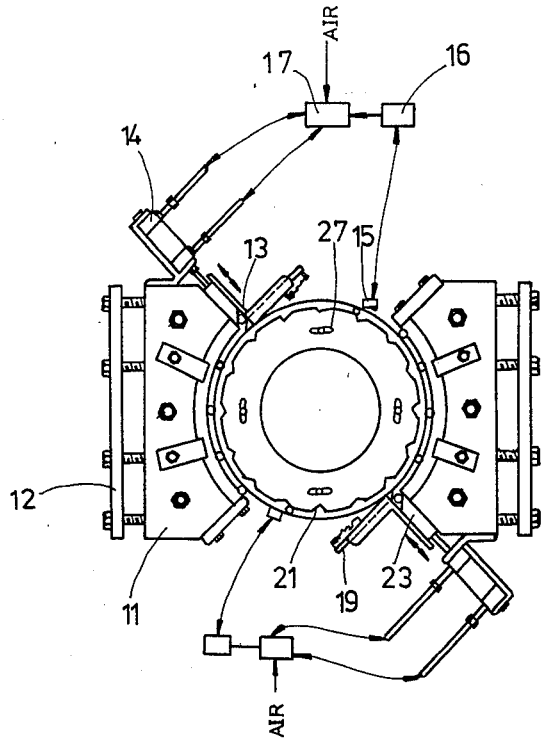
FIG. 7: An amplified top plan view of FIG. 4.
Figure 4:
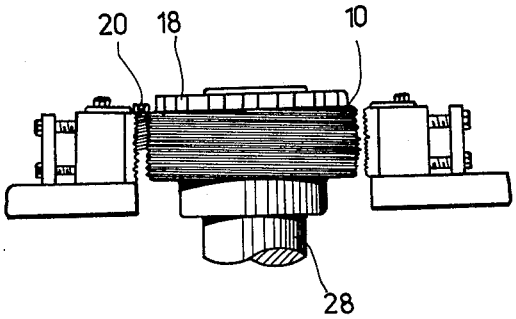
FIG. 4: A sectional diagram of a high speed dual path thread rolling machine.

FIGS. 4 and 7 show the construction of a high speed dual path thread rolling machine as disclosed herein.

Planetary thread rolling is applied in the invention: the components include rotary die 10, stationary segment die 11, holding plate 12, feeding holder 13, air cylinder 14, microswitch 15, timer 16, solenoid valve 17 and cam 18.

A major characteristic of the invention is the use of a pneumatic feeding holder for operation. It consists of an air cylinder 14 which generates forward and backward power by air and makes equidistant pushing with appropriate space and speed. It also intersects with another slide block 19 and the surface of rotary die 10 to form a three point support which can keep a working piece 20 erect and feed it into the stationary segment die 11 precisely along a surface of the rotary die 10. However, the operation of such a feeding holder is controlled by the grooves 21 of the cam 18 on the rotary die 10 and the microswitch 15. Grooves 21 are cut on the surface of the cam in a number equal to that of the rolling starting points. Each groove 21 matches the thread tip point on said rotary die 10 and the grooves 21 are cut precisely. After contact of a groove 21 with said microswitch 15, a timer 16 will more precisely control the said switch 15 and match rotation of the rotary die 10. The current through the timer 16 will allow the said solenoid valve 17 to give precise air supply action and then, air enters air cylinder 14 through a bypass so that the thrust block 23 of said cylinder 14 moves to and from very fast and when a space appears for feeding a work piece 20 (which is pushed by said thrust block 23 and held by said slide block 19, and contacted by the circumference of the rotary die 10), the work piece 20 is completely fed into the die for threading.

The structure of the above mentioned feeding holder 13 is simple, not complex and no space consuming chuck is required. In threading by means of the rotary die 10 and stationary segment die 11, there is a large reaction force and a balanced standing force is required. Therefore, another set of stationary segment dies 11 and a feeding holder 13 are set on the opposite side. The position of these components is corresponding and opposing the other set. Thus, the operation is in two paths and the production is doubled.

Figure 5A:
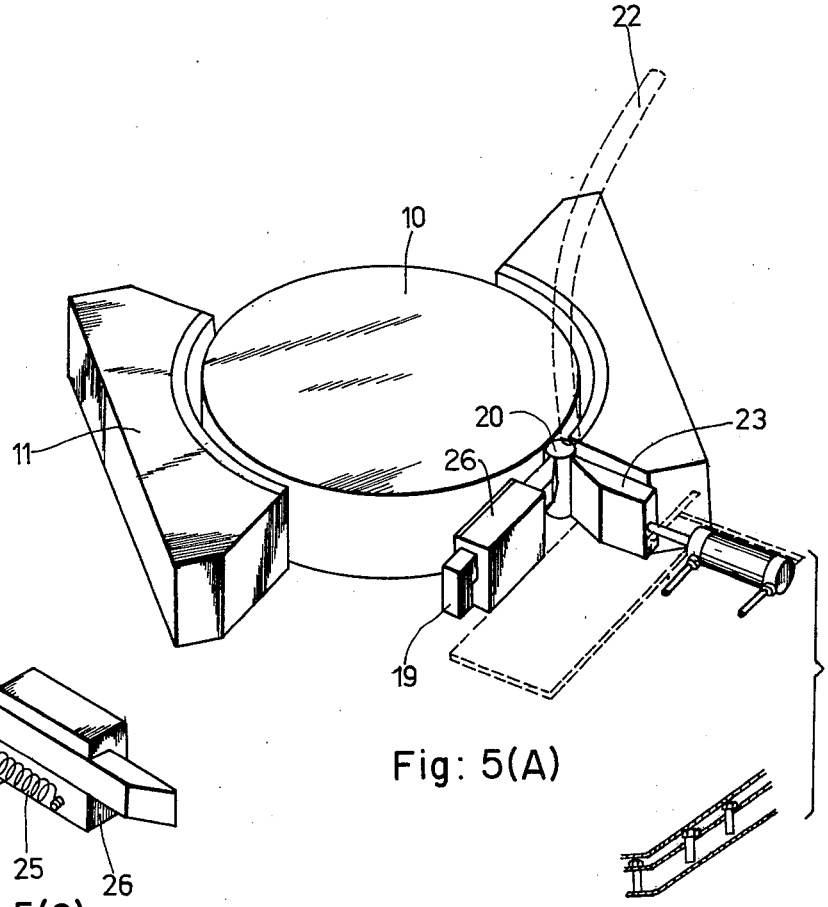
FIG. 5A: A work feeding station in perspective.
Figure 5C:
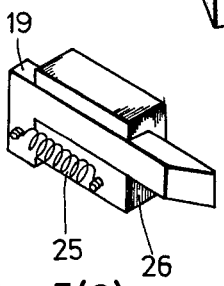
FIG. 5C: A perspective detailed view of an element of FIG. 5A.
Figure 5B:
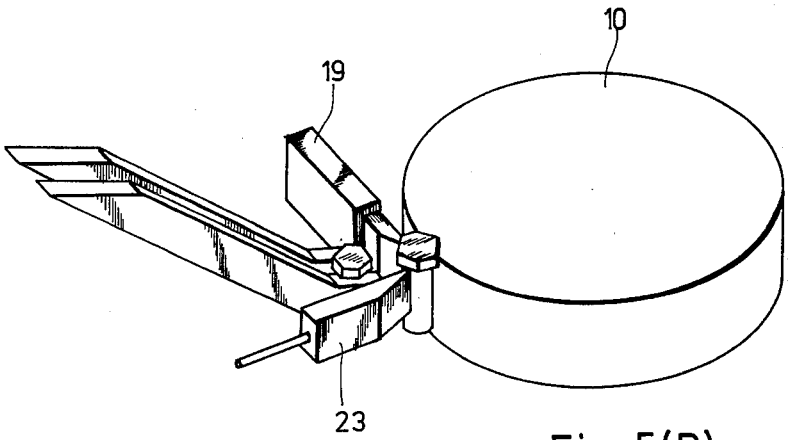
FIG. 5B: A work feeding station including a conveyor in perspective.

FIGS. 5A and 5B show the operation of the feeding holder 13 is disclosed herein. The working piece 20 can be a head screw or a headless screw. Headless screws drop into a space in front of the thrust block 23 through a round guide tube 22 (FIG. 5A). Action of the thrust block 23 is controlled by air from the air cylinder 14. The said thrust block 23 has a slightly declined tip and its top surface will slightly contact the said guide tube 22 in operation to cause a better feeding. Perpendicular to the said thrust block 23 is a slide block 19 slidable within a holder 26 with a spring 25 connected at one end to the block 19 (FIG. 5C) at its rear, and at its other end to the holder 26. When the said thrust block 23 moves forward, its force, through the work piece 20 causes the said slide block 19 to move backwards so that the work piece 20 is pushed to the circumference of rotary die 10. The slide block 19, by the force of the spring 25, pushes the work piece 20 forward, and then, the said thrust block 23, slide block 19 and rotary die 10 hold the said work piece 20 at three points simultaneously and feed the work piece 20 to the rolling starting point at this instant precisely.

Drawing 5B is for the making of head screws. The guide tube therein is of aligned cartridge type. When a working piece falls into an interval of a feeding holder, its head is above the said thrust block 23, slide block 19 and rotary die 10 and the body to be threaded is held in the same manner as above mentioned. In pushing and after feeding into die, its head is above rotary die 10 and stationary segment die 11 also.

In conclusion, the high speed dual path thread rolling machine is characterized by the use of two feeding holders for precise feeding of work pieces into a die by means of a microswitch, timer and solenoid valve. Further, it can be used for making both head and headless screws and the process is in two paths. The full process is completely automatic and the production is doubled. It is a precise and fast industrial process with industrial value.

What is claimed is:

1. A planetary rolling machine for forming screw threads on work piece blanks comprising in combination:

a substantially disc-shaped central rotary die having a thread forming surface on a side face thereof, at least one stationary segment die having a thread forming surface spaced from but proximate to said rotary die so as to allow passage of blanks between said side face of said rotary die and said thread forming surface on said stationary die, a feeder holder proximate to an inlet area between said stationary die and said rotary die and a discharge area proximate to a terminal portion of said stationary die remote from said inlet area, means for actuating said feeding holder, cam means fixedly mounted on said rotary die for rotation therewith, normally inoperative switch means for controlling said feeding holder actuating means, said switch means including a microswitch for periodic engagement by portions of said cam means during the rotation of said rotary die at each of plural starting points for actuation of said feeding holder, said cam means being arranged to operatively condition said switch means periodically during the rotation of said rotary die corresponding to the starting points of a threading operation on said blanks for actuation of said feeding holder to feed a blank, into said inlet area, and time adjusting means for altering the control between said switch and said feeding holder actuating means while the machine is running.

2. A planetary rolling machine in accordance with claim 1 wherein said time adjusting means includes a timer connected between said switch means and said actuating means to provide a predetermined period of time between the operative conditioning of said switch means and the actuation of said feeding holder.

3. The device of claim 2 wherein said feeding holders includes a retractable pneumatically operated thrust member and a resiliently biased retaining member, one of which is radially disposed, the other of which is tangentially disposed to said rotary die side face at one feeding area.

4. The device of claim 3, wherein said cam means includes a cam which travels with said rotary disc, the periphery of said cam being provided with teeth arranged in a predetermined number and spacing.

5. The device of claim 4 including a blank holding tube overlying said one feeding area of said pneumatic member whereby said pneumatic member is retracted, a further blank drops into said one feeding area, and said blank can be headless.

6. The device of claim 4 including an aligned cartridge having a linear slot for supporting depending blanks by their heads overlying said one feeding area.

7. A planetary rolling machine in accordance with claim 4 wherein a pair of said stationary segments dies are associated with said rotary die in diametrically opposed relationship each having a said inlet feeding area and wherein two of said feeding holders are provided each associated with one of said inlet feeding areas and wherein two of said microswitches are provided each associated with one of said feeding holders and arranged for actuation by said cam.

8. The device of claim 7 wherein said retaining member is tangentially disposed and includes a holder having a slide block disposed therewith interconnected by a spring.

* * * * *